US005339231A

United States Patent [19]

Parsolano et al.

[11] Patent Number: 5,339,231

[45] Date of Patent: Aug. 16, 1994

[54] SAFETY NIGHT LIGHT SYSTEM AND METHOD OF MANUFACTURE THEREOF

[75] Inventors: Veronica Parsolano, Floral Park, N.Y.; James E. Meehan, Ste. Veronique, Canada

[73] Assignee: Leviton Manufacturing Co., Inc., Little Neck, N.Y.

[21] Appl. No.: 973,909

[22] Filed: Nov. 10, 1992

[51] Int. Cl.[5] ..... F21V 33/00

[52] U.S. Cl. ..... 362/226; 362/95; 439/135

[58] Field of Search ..... 362/95, 226, 253, 295, 362/351, 353, 377, 378, 802; 439/135, 146

[56] References Cited

U.S. PATENT DOCUMENTS

| | | | |
|---|---|---|---|
| 2,166,790 | 7/1939 | Benander | 362/226 |
| 2,878,456 | 3/1959 | Cormier | 439/135 |
| 3,780,260 | 12/1973 | Elsner | 362/802 |
| 3,968,355 | 7/1976 | Smallegan | 240/2 R |
| 4,000,405 | 12/1976 | Horwinski | 240/25 P |
| 4,064,426 | 12/1977 | Tyler | 362/226 |
| 4,175,813 | 11/1979 | Mentesana | 439/135 |
| 4,343,032 | 8/1982 | Schwartz | 362/802 |
| 4,611,266 | 9/1986 | Schwartz | 362/226 |
| 4,714,984 | 12/1987 | Spector | 362/226 |
| 4,931,911 | 6/1990 | Hanson | 362/95 |

FOREIGN PATENT DOCUMENTS

| | | | |
|---|---|---|---|
| 365226 | 11/1938 | Italy | 439/135 |

*Primary Examiner*—James C. Yeung
*Assistant Examiner*—Y. Quach
*Attorney, Agent, or Firm*—Paul J. Sutton

[57] ABSTRACT

An improved night light incorporating effective safety features that greatly reduce the risk of electrocution by small children. The housing of the night light flares out towards its back surface to prevent an adult's or child's fingers from accidently contacting electrically live blades while inserting or removing it from an electrical receptacle. The blades are constructed so that their length is a function of the distance the blades are below the surface of a receptacle, the distance from the side of the blade where it protrudes from the back surface of the housing to the side edge of the housing and the distance from the bottom edge of the blade to the bottom edge of the back surface of the housing. A toggle provides on and off control of the night light. An open loop of spring metal provides the toggle with a snap action feel when operated. A snap on shade prevents glare to a user from direct exposure to the illuminating bulb.

11 Claims, 3 Drawing Sheets

SAFETY NIGHT LIGHT SYSTEM AND METHOD OF MANUFACTURE THEREOF

BACKGROUND OF THE INVENTION

Night lights for residential use are well known in the art. They are used primarily to dimly illuminate corridors and rooms in order to ease a child's fear of darkness, or to aid a person walking around at night in an otherwise dark environment. Night lights are especially common in children's rooms and in bathrooms to provide dim illumination. Traditionally, night lights have utilized standard length blades in their construction. Such a length is considered necessary to accommodate the electrical current needed by the night light, to secure the night light physically in the receptacle, and to ensure a secure electrical connection when the night light is fully plugged in. However, a night light with standard length blades unexpectedly exposes a gap between the body of the night light and the receptacle, whereby small children can insert their fingers into the gap while the night light is still plugged in, and thereby suffer an electrical shock.

Historically, this issue was not known or utilized in the design of night lights. Some have been designed with flared bases that lie flush against the wall when inserted in a standard duplex wall receptacle. The aim is to reduce the risk of a child or adult grasping the blades while inserting or removing the night light. However, there still remains a relatively small risk that the night light will be pulled out enough so that a small child's fingers can be inserted in the gap created between the wall and the back of the night light while the blades remain physically and electrically connected to the conductor in the receptacle. Therefore, a long felt need has existed for a safe night light designed such that, at all points including those where the blades make relatively minor contact with the conductor in the receptacle, it is impossible for a child's fingers to contact the live blades. The blades must be long enough to ensure a proper electrical connection and to securely support the night light in the receptacle.

BRIEF SUMMARY OF THE INVENTION

With the foregoing considerations in mind, the present invention teaches an improved night light which incorporates the advantages discussed, without any of the disadvantages.

More particularly, it is an object of the present invention, which is based on the hitherto unrecognized idea that a sufficient electrical and physical connection can be obtained without leaving the aforementioned gap between the connected night light and the wall, to provide a night light whereby the exposed distance of the blades from the back of the night light to the surface of the receptacle, at the point where the blades just make contact with the conductor inside a standard receptacle, is less than the smallest diameter of any finger of an infant capable of crawling, this distance being approximately ⅛ inch for infants capable of crawling.

It is a further object of the invention to provide a night light whose blades have a length of preselected proportion to the minimum distance from the point the blades protrude from the night light to either the horizontal or vertical edge of the night light.

It is a further object to provide a night light whose blade has a length which provides a sufficient electrical connection and securely supports the night light in a receptacle without leaving the aforementioned gap between the night light and the wall.

DETAILED DESCRIPTION OF THE INVENTION

Figure 1:
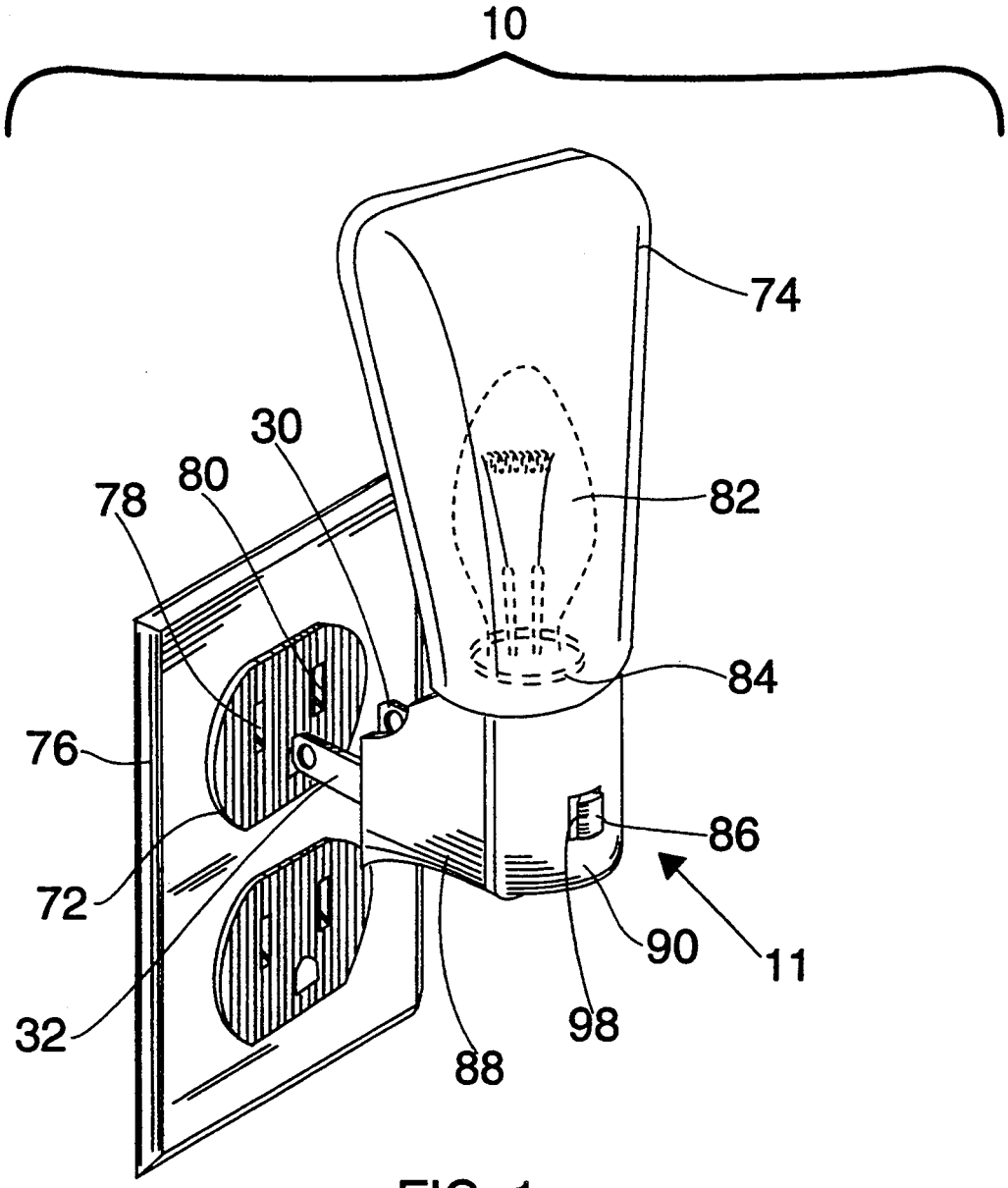
FIG. 1 is a perspective view of the preferred embodiment of the invention.

As shown in FIG. 1, what we will sometimes refer to as a "super safe" night light system 10 generally comprises a wall plate 76 and duplex receptacle 72 in combination with a night light 11. The night light 11 generally comprises a housing 88, cover 90, shade 74 and electrical means contained within the housing 88. The night light 11 is depicted in FIG. 1 about to be inserted into the duplex receptacle 72. Each receptacle of the duplex receptacle 72 includes two blade apertures 78, 80 that receive blades 32, 30. A source of alternating current is provided at the duplex receptacle that supplies power to the night light 11. A bulb 82 serves as the light source and is partly concealed by the shade 74 in order to cut glare. The shade 74 can be easily detached from the night light 11 if not desired by the user. The switch 86 serves to turn current flow to the bulb 82 on and off.

Figure 2:
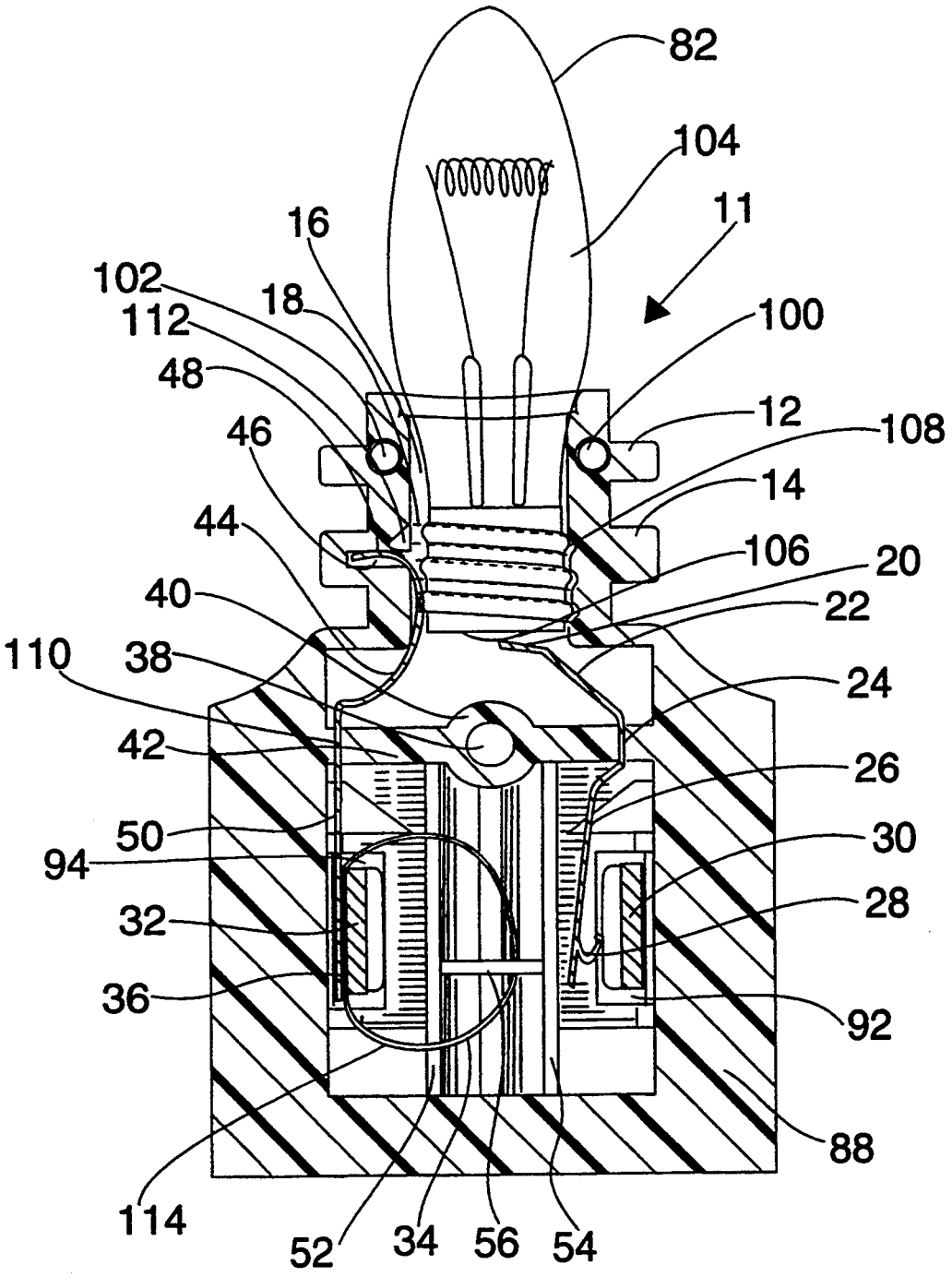
FIG. 2 is a front elevational view, partly in section, of the housing of the device of FIG. 1 with a bulb in position.
Figure 3:
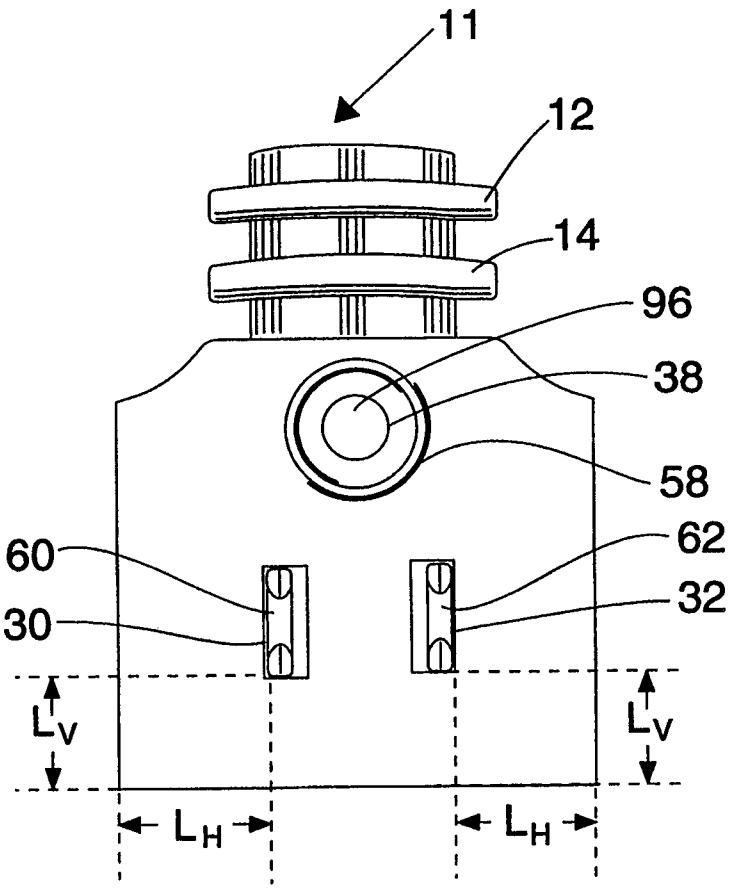
FIG. 3 is a rear elevational view, of the housing.
Figure 4:
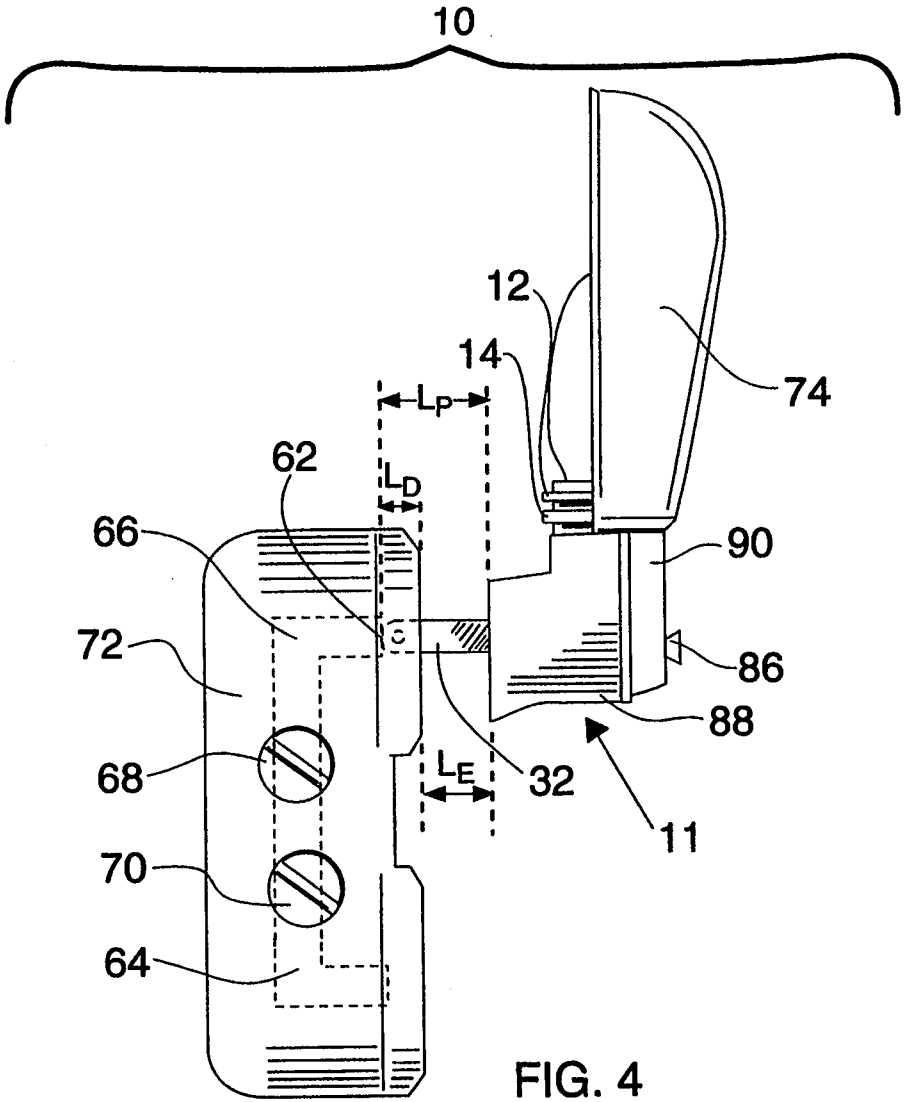
FIG. 4 is a side elevational view, of the night light of the instant invention together with a duplex receptacle into which the night light is plugged.

As shown in FIGS. 2, 3 and 4, the housing 88 provides support for and contains most of the component parts of the night light 11. The rectangularly shaped housing 88 and cover 90 can be made from insulating molded plastic parts. The rear surface of the housing 88 is flat so that when blades 32, 30 are fully inserted in the receptacle 72, the rear surface of housing 88 lies flush with the surface of the wall plate 76. The vertical sides and bottom side of the housing 88 flare outwardly away from the blades 32,30 adjacent the rear surface of housing 88 in order to provide a greater distance from the blades 30, 32 to the rear edges of the vertical sides and the bottom side of the housing 88. This safety feature greatly reduces the risk of electrocution by children and adults who accidently wrap their fingers around the housing 88 of the night light while inserting or removing it from the receptacle 72. The front surface of the housing 88 mates with the rear surface of the cover 90 and they are held together by a fastener 96 that extends through the aperture 38. The fastener aperture 38 is centered in the fastener portion 40 of the housing 88, centrally located on the transverse portion 42, and provides rigidity for the fastener 96. The circular raised ring 58 projects from the rear surface of the housing 88 enclosing the fastener 96 and aperture 38. The upper shade ring 12 and the lower shade ring 14 are uniform circular projections extending from the top portion of the housing 88. A lip on the bottom end of the plastic shade 74 (not shown) snaps into the space between the upper shade ring 14 and the lower body of the cover 90. Alignment pins 100, 102 lie in the same plane as the upper shade ring 12 and fit into mating holes on the rear surface of the cover 90, at the plane of the upper shade ring 12 (not shown). When the pins 100, 102 enter their corresponding holes in cover 90 the housing 88 and cover 90 are aligned for the assembly of the cover 90, said housing 88. The bulb's threaded portion 18, which is screwed into the night light 11 using the socket threads located in the top portion of the housing 88 and cover 90, which threads consist of mating molded projections on both the housing 88 and cover 90. Alignment of the thread halves is assured by the engagement of the pins 100, 102 with corresponding holes in cover 90. The base 84 of the bulb 82 lies within the bulb chamber 16 and its lamp portion 104 extends vertically from the bulb chamber 16. The center contact 106 located on the base 84 of the bulb 82 makes electrical contact with the upper portion 20 of the switch contact 26. The upper straight portion 22 of the switch contact 26 applies a spring-like force to the upper portion 20 in order for the center contact 106 to make effective electrical contact with the upper portion 20. The switch contact 26 is secured permanently in place by a notch in the transverse portion 42 that retains the securing portion 24.

The leaf spring contact 44 of the leaf spring 110 makes electrical contact with the base threads 108 of bulb 82. The end portion 46 of the leaf spring contact 44 is held within the contact recess 48. It is secured by the end portion stop 112 which is a triangularly shaped projection on the upper surface of the housing 88. The straight portion 50 of the leaf spring 110 is secured by the pressure of the blade 32 against the side of the housing 88. The leaf spring 110 is able to pivot at the place where straight portion 50 and contact 44 meet; thereby allowing the leaf spring contact 44 to flex, conforming to the base threads 108 of the bulb 82 when it is in place in the bulb chamber 16.

The blades 30, 32 extend through apertures 92, 94 respectively, located on the back surface of the housing 88. They extend horizontally through the body of the housing 88 along its sides to protrude slightly beyond the back surface of the housing 88. The switching portion 28 makes contact with the inner surface of the blade 30 when the switch 86 is in the on position. The switching portion 28 of the switch contact 26 is split along its length creating two tabs, one of which curls backwardly to form a spring contact. The bottom portion of the switch 86 moves against the inner surface of the lower tab of the switching portion 28 causing the lower tab to make and break contact with the inner surface of the blade 30. The switch contact 26 can flex due to the securing portion being held in place in a slot in the transverse portion 42.

The switch 86 extends through a switch aperture 98 on the front surface of the cover 90. The horizontal portion of the switch 86 resides within the housing 88. A toggle spring 114 provides a positive snap action feel to the switch 86 when it is turned to the on or off position. The switch 86 pivots in notches that lie on the inside of the switch aperture 98. The spring consists of a curved portion 34 that gives the switch 86 its toggle action and a straight portion 36 that fits into an anchoring slot formed between blade 32 and a side wall of housing 88 as shown in FIG. 2. The ends of the curved portion 34 straddle both sides of the raised ridge 56 that runs transversely between raised ridges 52, 54. The ridges 52, 54 are integral with the transverse portion 42 on either side of the fastener portion 40. They extend to the inner surface of the housing 88.

The night light system, shown in FIGS. 3 and 4, consists of the combination of the duplex receptacle 72 and the night light 11. Terminal fasteners 68, 70 secure electrical wire supplying power to the receptacle. The fasteners 68, 70 are electrically connected to the electrical conductor 64 inside the receptacle 72. The upper portion 66 of the electrical conductor 64 provides power to and makes contact with the blades 32, 30 that are inserted into the blade apertures 78, 80 respectively. The night light system 10 has been designed such that at the point where the outer surfaces of the blades 30, 32, adjacent the end surfaces 60, 62 respectively, just make contact with the inner surfaces, adjacent their ends, of the electrical conductors 64 of the upper portion 66 so that the exposed length of the blades 32, 30 is minimized. The total blade length $L_P$ of the night light 11 can be represented mathematically as the sum of the length $L_D$ of the blade disposed within the duplex receptacle 72 (i.e. within the blade apertures 78, 80) and the length $L_E$ of the exposed portion of the blade as shown in Eq. 1.

$$L_P = L_D + L_E \tag{1}$$

The exposed length $L_E$ of the blades 30, 32 can be defined as a function of the horizontal distance $L_H$ from the closest side edge of the housing 88 to the edge of the outer surface of the adjacent blade 30, 32 and the vertical distance $L_V$ from the bottom edge of the housing 88 to the bottom edge of the blades 30, 32. The objective is to allow the exposed blade length $L_E$ be directly proportional to the lengths $L_H$ and $L_V$ up to a predefined limit. The goal is to prevent accidental electrocution by minimizing the exposed length $L_E$ of the blades 30, 32 so as to preclude the possibility of human fingers, especially small children's, from gaining access to the blades at the same time the night light is receiving power. The aim is to have blades short enough such that, as the night light 11 is removed by a small child, the blades 30, 32 disengage from and break electrical contact with the electrical conductor 64 in the receptacle 72 by the time the child can fit his or her fingers between the back of the housing 88 and the receptacle 72. The relationship between $L_E$, $L_H$ and $L_V$ is expressed in Eq. 2 as immediately follows.

$$L_E = K_1[1 - e^{-K_2 MIN(L_H, L_V)}] \tag{2}$$

Where constants $K_1$ and $K_2$ are given by:

$$K_1 = 0.3935 \text{ inch} \tag{3}$$

$$K_2 = 1.5290 \text{ inch}^{-1} \tag{4}$$

The calculation of the multitudinous configurations of the night light which can be achieved using the above formula can be accomplished by virtually any commercial general purpose computer.

The minimum distance of $L_H$ and $L_V$ is used in Eq. 2 in case the two distances are not equal. The blade length specified by Eq. 2 is short enough to preclude the possibility of an infant, capable of crawling, and having the smallest fingers from contacting the blades 30, 32 while the night light 11 is electrically connected to the electrical conductor 64. As represented in Eq. 2, the exposed blade length $L_E$ varies proportionally with the minimum of $L_H$ and $L_V$. As $L_H$ or $L_V$ increases $L_E$ also increases. However, a maximum of $\frac{3}{8}$ inch and a minimum of $\frac{1}{8}$ inch is imposed on $L_E$. A minimum is needed to insure that the night light is properly secured in the receptacle.

An alternate method of establishing the blade length in consonance with the rest of the invention is to have the blades 30, 32 protrude from the housing 88 and, at their respective extreme ends, barely mate with and establish an electrical connection with the electrical conductor 64 mounted within the duplex receptacle 72. The blades 30, 32 mate with the conductor 64 at the point wherein the distance between the surface of the duplex receptacle 72 and the back surface of the housing 88 is shorter than the smallest diameter of the smallest circumference finger of an infant able to crawl when the night light 11 is positioned such that the edge of the either blade 30, 32 that is furthest from the housing 88 just begins to make electrical contact with the electrical conductor 72, where the distance is no less than ⅛ inch and no greater than ⅜ inch.

The embodiments of the invention disclosed in the present specification and drawings and claims are presented merely as examples of the invention. Other embodiments, forms, or modifications thereof will readily suggest themselves and are contemplated as coming within the scope of the present invention.

What is claimed is:

1. A night light comprising: a housing having a front wall and a rear wall;

a cover integral with said housing light source receiving means for receiving a light source and mounted within said housing;

electrical conductors mounted within an electrical outlet;

shockproof safety means for establishing an electrical connection between said light source receiving means and said electrical conductors mounted within said electrical outlet;

said shockproof safety means comprising a first and a second blade, each protruding from said rear wall of said housing and having a free end and capable of being inserted into said electrical outlet, said first and second blades when so inserted each engaging a different one of said electrical conductors, the surfaces of said first and second blades adjacent their respective free ends barely mating with and establishing an electrical connection with its associated electrical conductor mounted within said outlet wherein the spacing between a surface of said electrical outlet and the rear wall of said housing is no less than ⅛ inch and no greater than ⅜ inch.

2. The night light of claim 1, wherein said housing has two side walls, a bottom wall and a top wall, each wall extending between said front and rear walls, the perimeter of said housing at said front wall is shorter than the perimeter of said housing at said rear wall thus effecting a flaring out of said side walls and said bottom wall of said housing near said rear wall and thereby preventing users from inadvertently contacting said first and second blades.

3. The system of claim 1, further comprising:

a shade connected to said housing and said cover to prevent glare from being sensed by a user directly exposed to said light source inserted in said light source receiving means.

4. The system of claim 1, further comprising switching means to control said night light's on and off operations.

5. The system of claim 4, wherein said switching means comprises a toggle that provides a control input to said user and toggle means that provides a positive snap action feel to said toggle.

6. The system of claim 5, wherein said toggle means comprises a toggle spring, said toggle spring formed with an open loop of thin springy metal having a substantially straight portion and two ends, the ends of said open loop of metal resting on either side of a short projecting partition located within said housing, the straight portion of said open loop of metal being held within an anchoring slot formed between a blade and a wall of said housing.

7. The system of claim 1, wherein said cover together with said housing serve to fully contain said shockproof safety means and said light source receiving means, said housing and said cover being held together by fastening means.

8. A method for constructing a night light, said method comprising the steps of:

constructing a housing, having a rear wall defined by a top edge, a bottom edge and two spaced apart side edges which together define said rear wall; said rear wall of said housing having first and second apertures therethrough, there being a minimum distance $L_H$ from each of said apertures to its adjacent side edge and a minimum distance $L_v$ from each of said apertures to its adjacent bottom edge;

mounting first and second blades, respectively, into said first and second apertures, each of said first and second blades having a length $L_p$ which length is the sum of an exposed blade length $L_E$ of said blade outside a standard wall receptacle into which said blade is inserted and a length $L_D$ of said blade which length is the length of said blade within said standard wall receptacle when the respective free ends of said first and second blades just touch their associated electrical conductors in said standard wall receptacle to establish electrical contact therewith; and calculating said exposed blade length $L_E$ for at least one configuration of said night light such that such exposed blade length is no less than ⅛ inch and no more than 0.3935 inch said calculation being done according to the formula:

$$L_E = K_1[1 - e^{-K_2 MIN(L_H, L_V)}]$$

where $K_1$ is a constant 0.3935 inch and $K_2$ is a constant 1.5290 inch.

9. A night light made by the method of claim 8.

10. The method of claim 8, wherein said step of calculating is done by computer means.

11. A night light comprising: a housing having a rear wall defined by a top edge, a bottom edge and two spaced apart side edges which together define said rear wall;

light source receiving means for receiving a light source and mounted within said housing;

electrical conductors mounted within an electrical outlet;

shockproof safety means for establishing an electrical connection between said light source receiving means and said electrical conductors mounted within an electrical outlet;

said shockproof safety means comprising first and second blades, respectively, protruding from said rear wall of said housing such that said first blade is spaced from its closest side edge by a horizontal distance $L_H$ and said second blade is spaced from its closest side edge by the same horizontal distance $L_H$ and said first and second blades are spaced from said bottom edge by a vertical distance $L_V$ and, said first and second blades each having a length $L_P$ from said rear wall to its respective extreme free end to permit the blade free ends to barely mate with and establish an electrical connection with said conductors mounted within said outlet wherein said first and second blade length $L_P$ is the sum of the respective lengths $L_D$ of said first and second blades within said electrical outlet added to the distance $L_E$ between a front surface of said electrical outlet and the rear wall of said housing when said night light is positioned such that said respective extreme free ends of said first and second blades barely make electrical contact with said electrical conductors wherein said distance $L_E$ is no less than $\frac{1}{8}$ inch and no greater than $\frac{3}{8}$ inch and wherein $L_E$ is related to said horizontal and vertical distances $L_H$ and $L_V$, respectively, according to the following equation:

$$L_E = K_1[1 - e^{-K_2 MIN(L_H, L_V)}]$$

Where constants $K_1$ and $K_2$ are given by:

$K_1 = 0.3935$ inch $K_2 = 1.5290$ inch and wherein said length $L_P$ is measured according to the equation: $L_P = L_D + L_E$.

* * * * *